United States Patent [19]

Leeper

[11] 4,018,039

[45] Apr. 19, 1977

[54] DEVICE FOR SPLICING ROPE

[76] Inventor: Ralph S. Leeper, 177 Steamboat Ave., North Kingstown, R.I. 02852

[22] Filed: Oct. 20, 1975

[21] Appl. No.: 624,178

[52] U.S. Cl. ..... 57/23

[51] Int. Cl.[2] ..... B65H 69/06

[58] Field of Search ..... 57/22, 23, 159

[56] References Cited

UNITED STATES PATENTS

| | | | |
|---|---|---|---|
| 748,714 | 1/1904 | Fesenfeld | 57/23 |
| 959,407 | 5/1910 | Urbanz | 57/23 |
| 1,261,145 | 4/1918 | Maki | 57/23 |
| 1,283,044 | 10/1918 | Beasley | 57/23 |
| 2,261,447 | 11/1941 | Payne | 57/23 |
| 2,384,992 | 9/1945 | Garlinghouse | 57/23 |
| 2,491,256 | 12/1949 | Engelke | 57/23 |
| 2,739,439 | 3/1956 | Elsner | 57/23 |
| 3,295,303 | 1/1967 | Beveridge | 57/23 |

*Primary Examiner*—John Petrakes
*Attorney, Agent, or Firm*—Salter & Michaelson

[57] ABSTRACT

A device for splicing rope having a hard terminal end such as formed by melt cutting, comprising a hollow conical fid having an open slot along one face thereof, said slot decreasing in width along a major extent of such fid from the base to the apex thereof, said fid adapted to pierce and form an initial opening in a running length of said rope. A downwardly extending, generally flat tapered blade is adapted to be received in said slot for forcing said rope downwardly on the fid so as to progressively expand such opening so that a hardened end thereof may be passed therethrough and received by the slot. When the rope is upwardly removed from the fid, the narrowing taper of the slot wedges the hardened end therein, thus preventing its upward movement and thus enabling relative movement between the rope end and the running length thereof so as to result in automatic threading of the rope end through the opening to form a splice therein.

12 Claims, 6 Drawing Figures

DEVICE FOR SPLICING ROPE

BACKGROUND OF THE INVENTION

Splicing of rope includes both the formation of a closed loop at one end, i.e., an eye splice, and the joining of two running lengths. Such splicing traditionally includes the separation of an end or end portions of rope to constituent parts, lays or strands and the subsequent integration of such strands in a braid like form. This is time consuming and involves a fair degree of learned experience. Also in traditionally splicing ropes made of synthetic material such a nylon, dacron, polypropylene etc. as distinguished from manila, hemp, sisal etc., it is necessary that each strand end be whipped or otherwise held together as by melt fusing so that the ends thereof will not exhibit their normal tendency to open or fluff up and thus render splicing even more difficult.

Accordingly, there exists a need for a device for splicing rope in a manner which is more specifically adapted to the modern ropes formed of synthetic materials.

SUMMARY OF THE INVENTION

The present invention accomplishes this aim by the provision of a device having a hollow conical fid in turn having an opening slot along one face thereof, said slot decreasing in width from the base to the apex thereof. The fid is adapted to impale and pierce a running length of rope. Further included are means including a downwardly tapered generally flat blade for simultaneous receipt in said fid slot and said initially formed rope opening for forcing said rope downwardly over the fid to progressively expand said opening whereupon an end of rope hardened as by melt cutting may be positioned adjacent to or through said opening and received in the slot. The taper of the slot holds the end of the rope by a wedging action when said rope is removed upwardly from said fid thus enabling a rope end to be forced through a running length of rope with ease. The procedure may be repeated so that the same end of rope passes through one or more openings subsequently formed in the same manner along the running length in order to increase the frictional coaction between the rope portions and accordingly the stability of the splice formed therein.

It is therefore a primary object of the present invention to provide a device for splicing rope, especially the modern synthetic types, wherein a hard rope end such as formed by a melt cutting operation passes through at least one opening formed in a running length of said rope.

Another object of this invention is the provision of a device including a hollow upright generally conically shaped fid for receipt and initial formation of an opening in a running length of rope which opening may be progressively and conveniently enlarged so as to easily receive an end of a rope passing therethrough.

A further object of the invention is the provision of a device including a hollow generally conical fid having an open progressively tapered slot on one side thereof and of a cooperating blade structure to progressively form openings of greater size through a running length of rope impaled upon said fid wherein damage to individual strands or fibers of said rope is minimized.

Other features and advantages of the invention will be apparent as the description thereof proceeds in connection with the accompanying illustrative drawing.

DESCRIPTION OF THE DRAWINGS

In the drawing which illustrates the best mode presently contemplated for carrying out the present invention.

DESCRIPTION OF THE INVENTION

Figure 1:
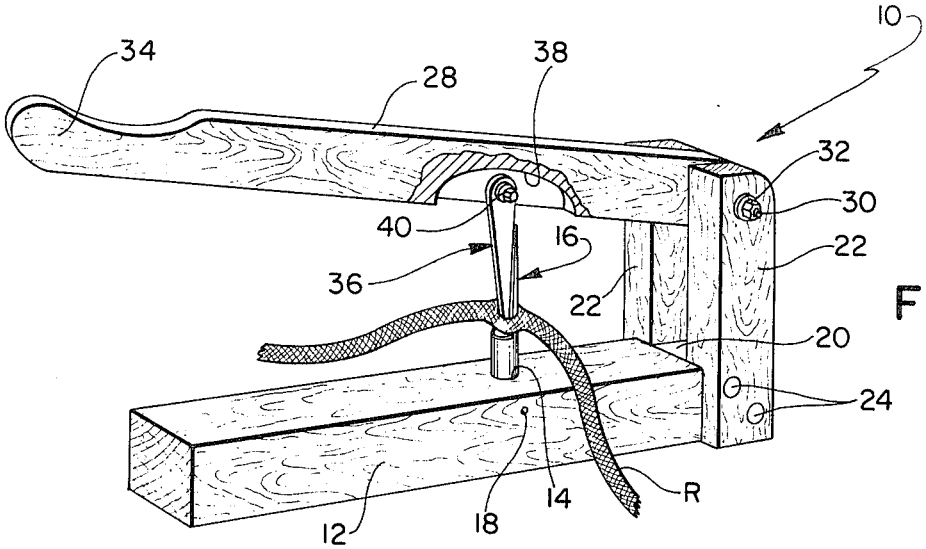
FIG. 1 is a perspective view of a device for splicing rope constructed in accordance with the instant invention and showing the overall construction thereof.

Turning now to the drawings and in particular FIG. 1 thereof, a device 10 of the present invention is depicted as including a support 12 having opening 14 for the receipt of a fid 16. The opening 14 is slightly oversized in comparison to the base of the fid 16 so that the fid may slightly pivot or wobble therein for a reason which will become apparent hereinafter. The fid is retained in the opening 14 by means of a shaft 18 passing through openings (not shown) in the base of the fid. One end of the support is in turn provided with a tongue or extension 20 to which a pair of upstanding opposed members 22 are rigidly attached by means bolts 24 so as to cooperatively form a bifurcated member 26 in turn adapted to pivotly support arm 28 for movement towards and away from support 12 by means of aligned openings (not shown) respectively formed in members 22 and the arm 28 for receipt of a pivot shaft 30 retained by fastening means 32. The opposite end of the arm 28 is provided with a handle portion 34.

A blade 36 is in turn pivotably supported from the arm 28 within a slot 38 formed therein, by means of shaft and fastening means 40. The placement of the blade 36 along the arm 28 is such that when the arm 28 is lowered, the blade and fid cooperatively interfit with each other. Also because the arm is pivotably connected as shown, it assumes an arcuate path of travel which necessitates that the blade be mounted for free back and forth swinging movement along the longitudinal extent thereof and that the fid be preferably slightly pivotable within its opening 14 as previously explained so as to make up for slight dimensional differences caused by such slightly arcuate approach of the blade, towards the fid. Also as the arm 28 is upwardly pivoted, the blade 36 is free to swing within the slot 38 and may preferably be partially or wholly retained therein in an over center position. The term upwardly and downwardly as used herein are relative and refer to the directions depicted in the drawing rather than absolute directions which of course can vary as can the attitude of the device 10.

Figure 3:
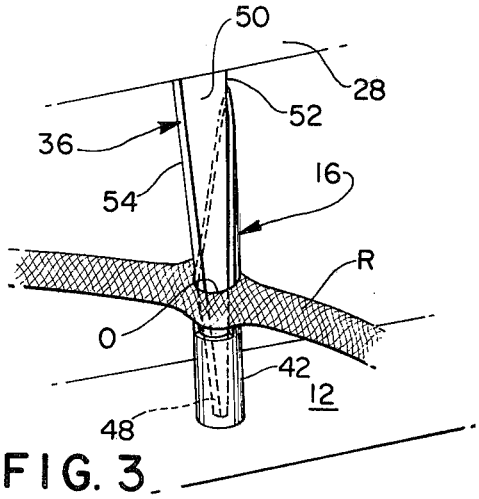
FIG. 3 is a partial perspective view of a device similar to FIG. 2 but wherein the blade has been removed and showing in particular a running length of rope impaled upon the upright fid and open to its full extent.

Turning now to FIG. 3 of the drawing, the construction of the fid 16 is best depicted. The fid 16 is a hollow conical shape having a base 42 which gradually narrows and terminates in a sharp apex 44. One face of the fid is provided with an open slot 46 decreasing in width along a major extent thereof from the base 42 to the apex 44 thereof. The base 42 of the fid preferably reaches its maximum useful circumferential extent which in turn determines to a major extent, the size of the opening to be formed in a running length of rope and accordingly the maximum rope diameter utilizable with a particular fid. The base may thereafter exhibit a slot construction which continues to outwardly expand or inwardly extend either slightly as shown in the drawing at 47 or entirely abutting each other so as to maximize the rigidity of said fid.

The fid 16 is adapted to receive a running length of rope R on the apex thereof, which apex can be initially forced therethrough to form an initial opening in the rope, as by manually grasping the rope and forcing it downwardly over the fid. Stainless steel or some other hard, smooth, low friction material is preferable and suitable for the formation of fid 16.

Figure 2:
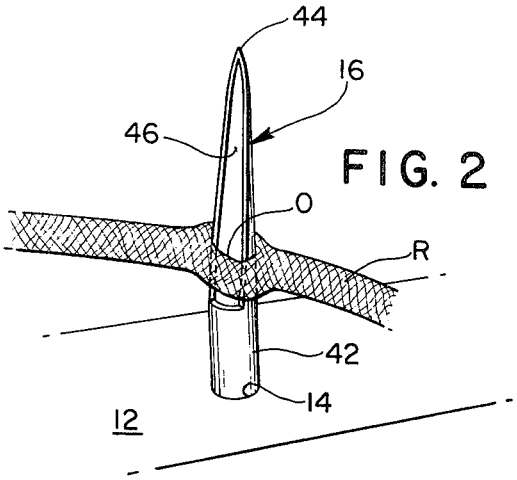
FIG. 2 is a partial perspective view showing the relative cooperating movement of the blade within the fid slot for forcing a running length of rope downwardly upon the fid while progressively expanding the opening formed therein.

The blade 36 is generally flat and includes a narrow end 48 which outwardly tapers to a wider base 50 and is formed of a relatively higher friction material than the material utilized to form the fid, such as brass, so that its contact with the fid will give a better bearing action and tend to reduce frictional wear upon the fid which is of a more complex shape and accordingly more costly to replace. The blade has an inner edge 52 adapted for general contact with interior surface portions of fid 16 as best shown in FIG. 2 of the drawing and an outer edge 54 of smooth rounded cross sectional configuration along the major extent thereof. The blade is adapted to be initially received within the upper portions of the slot 46 and the opening in the rope R initially formed by forcing the rope downwardly over the apex 44 of the fid. Thereupon continued downward pressure on the handle 34 forces the blade 36 further and further into the slot so as to progressively engage that portion of the rope opposite the slot as best depicted in FIG. 2 of the drawings. It should be noted that the side of the fid opposite the slot 46 is generally straight, that is, the fid is of a partially conical configuration. The inner blade edge 52 is also of relatively straight configuration and is adapted to engage said straight fid wall as the blade is progressively moved downwardly within the slot 46. This action thus progressively enlarges the opening in the rope by the latter's progressive contact with the downwardly increasing circumferential extent of that fid and that portion of the outer blade edge 54 projecting outwardly from the slot 46.

Figure 4:
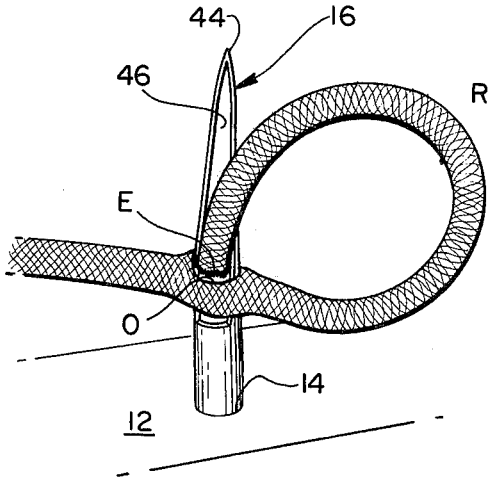
FIG. 4 is a partial perspective view similar to FIG. 3 showing the end of the rope positioned adjacent to or through the opening and into the hollow interior of the fid at the base portion thereof.
Figure 5:
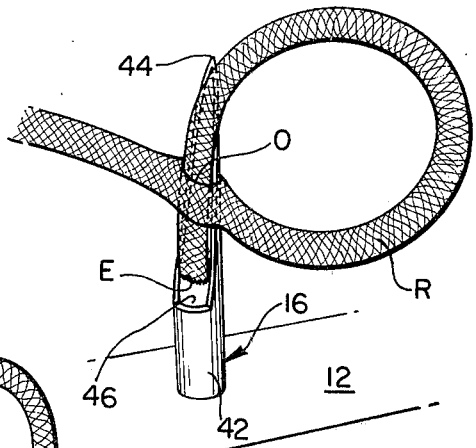
FIG. 5 is a partial perspective view similar to FIG. 4 showing the splice moved toward the apex of the fid with the end of the rope completely passed through the opening.
Figure 6:
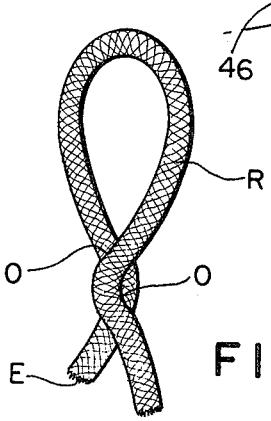
FIG. 6 is a perspective view showing the splice with the end of the rope passed through two openings.

The smooth rounded configuration of the blade edge 54 and that of the outer surfaces of fid 16 cooperate to minimize any frictional cutting of individual strands or fibers of rope surrounding the opening and assures a minimal frictional drag thereupon as the rope progresses downwardly over the fid. Once the opening has been enlarged to the extent necessary to receive an end E of the rope R, the blade is withdrawn. As best seen in FIG. 4 of the drawings, the end E, which automatically becomes fused and hardened during the cutting process, is then inserted adjacent to or through the opening 0 and the slot 46 into the interior of fid 16. After such has been tightly engaged therein the running length of rope is upwardly worked along the fid towards its apex 44 as shown in FIG. 5. Such initial upward action causes the end of the rope E or that portion thereof adjacent thereto to become wedged against the decreasing width of the slot 46 as it attempts to move upwardly. This enables the end to be conveniently held against upward movement and assures that it completely passes through the opening 0, thus completing the splice. Once the opening has cleared the apex 44 of the fid, a slight downward pressure on the end of the rope will free it from its wedged contact with the edges of slot 46. This splice may be considered complete at this point or further operations may be carried out so as to form additional openings further down the running length of the rope R and the progressive workings of the end E therethrough in the same manner as hereinabove described. Such a configuration showing an end passing through two such openings is depicted in FIG. 6 of the drawing. It will be understood that when the end of the rope has made only one pass through the running length of the rope, a slidable or "slip" eye is formed that may easily be enlarged or decreased in size. When, however, more than one pass has been made, as in FIG. 6, then the eye is securely fixed and maintained to size.

The invention has particular utility as previously indicated with synthetic type ropes, inasmuch as such rope when cut by local heat application i.e. hot wire, present an end wherein the individual strands thereof are fused together to form a hard unitary mass which does not fray. The present invention thus has utility with ropes exhibiting such hard ends whether occurring inherently or formed by fuse cutting or other means. Also while ropes of braided construction better withstand the above described forced formation of openings therethrough, the invention does have utility with other types of rope construction such as conventional three ply overlaid construction wherein it is desirable to centrally pierce at least one of the plied strands rather than as with braided construction, attempting to work the pointed apex of the fid between such strands to form the initial opening within the rope.

While there is shown and described herein certain specific structure embodying the invention, it will be manifest to those skilled in the art that various modifications of the parts may be made without departing from the spirit and scope of the underlying inventive concept and that the same is not limited to the particular forms hereinshown and described except insofar as indicated by the scope of the appended claims.

What is claimed is:

1. A device for splicing rope having a hard terminal end formed as by melt cutting comprising, a hollow conical fid having an open slot along one face thereof, means for mounting said fid in position to impale and pierce a running length of said rope so as to form an opening therethrough, means for forcing said rope downwardly on said fid toward said base thereof to progressively expand said opening, said fid temporarily maintaining said opening in said expanded condition so as to permit the hard end of said rope to be positioned adjacent said opening for subsequent passage therethrough, said slot decreasing in width at least along that extent thereof adapted to temporarily receive said running length of rope from the base to the apex thereof and said slot further adapted to receive said hard rope end and to temporarily wedge said end against relative movement therein by reason of its decreasing width configuration when said running length of rope proximate said opening is upwardly withdrawn from said fid, whereby said hard end automatically threads through said opening as the rope is upwardly withdrawn, said means for forcing said rope downwardly on said fid comprising a downwardly tapered blade having a narrow apex adapted for receipt in said slot and said opening, and means for moving said blade downwardly relative to said fid.

2. In the device of claim 1, said means for moving said blade relative to said fid comprising an arm suspended for pivotal movement above said fid, said blade being pivotably suspended from said arm.

3. In the device of claim 2, said fid being slightly pivotable relative to said mounting means.

4. In the device of claim 2, said means for mounting said fid comprising a support, said support having an upwardly projecting bifurcated member rigidly attached to one end thereof, said arm having one end thereof connected to said bifurcated member for pivotal motion towards and away from said support.

5. In the device of claim 4, said arm having a handle portion at the other end thereof.

6. In the device of claim 5, said fid slightly pivotable relative to said support.

7. In the device of claim 1, said blade having inner and outer edges, said inner edge adapted for contact with inner wall portions of said fid opposite said slot, said outer edge outwardly projecting form said slot and adapted to contact portions of said rope surrounding said opening so as to enlarge opening greater than the circumferential extent of said fid at the point where said rope is temporarily positioned.

8. In the device of claim 7, said outer blade edge having smooth rounded rope contacting edges.

9. In the device of claim 7, said fid constructed of material exhibiting smooth, hard, low friction, outer rope-contacting surfaces, such as stainless steel.

10. In the device of claim 7, said fid constructed of a relatively hard metal such as stainless steel, and said blade constructed of a relatively soft metal such as brass.

11. In the device of claim 7, said blade and said fid having generally triangular configurations, said inner blade edge and said inner wall portions of said fid being relatively straight, said outer blade edge tapering downwardly inwardly towards the base of said fid when positioned in said slot, and said fid tapering upwardly inwardly from said base thereof.

12. In the device of claim 1, said open slot decreasing in width along a major extent thereof and said blade being of generally flat configuration.

* * * * *